US006253940B1

(12) United States Patent
Graham et al.

(10) Patent No.: US 6,253,940 B1
(45) Date of Patent: Jul. 3, 2001

(54) TAMPER-INDICATING CLOSURE AND METHOD OF MANUFACTURE

(75) Inventors: Paul R. Graham, Holland; Charles A. Webster, Bowling Green; James L. Gregory, Toledo, all of OH (US)

(73) Assignee: Owens-Illinois Closure Inc., Toledo, OH (US)

( * ) Notice: Subject to any disclaimer, the term of this patent is extended or adjusted under 35 U.S.C. 154(b) by 0 days.

(21) Appl. No.: 09/301,282

(22) Filed: Apr. 28, 1999

(51) Int. Cl.[7] ..... B65D 41/34
(52) U.S. Cl. ..... 215/252
(58) Field of Search ..... 215/252; 53/420, 53/471, 490; B65D 41/34

(56) References Cited

U.S. PATENT DOCUMENTS

| | | | | |
|---|---|---|---|---|
| 4,552,328 | | 11/1985 | Dutt et al. . | |
| 4,560,076 | * | 12/1985 | Boik | 215/252 |
| 4,572,388 | * | 2/1986 | Luker et al. | 215/252 |
| 4,573,601 | | 3/1986 | Berglund . | |
| 4,611,723 | * | 9/1986 | Megowen | 215/252 |
| 4,625,875 | | 12/1986 | Carr et al. . | |
| 4,657,153 | * | 4/1987 | Hayes | 215/252 |
| 4,978,016 | * | 12/1990 | Hayes | 215/252 |
| 4,981,230 | * | 1/1991 | Marshall et al. | 215/252 |
| 5,058,755 | * | 10/1991 | Hayes | 215/252 |
| 5,080,246 | * | 1/1992 | Hayes | 215/252 |
| 5,086,938 | | 2/1992 | Aichinger . | |
| 5,107,998 | | 4/1992 | Zumbuhl . | |
| 5,295,600 | * | 3/1994 | Kowal | 215/252 |
| 5,443,853 | * | 8/1995 | Hayes | 215/253 X |
| 5,660,290 | * | 8/1997 | Hayes | 215/252 |
| 5,913,436 | * | 6/1999 | Breuer | 215/252 |
| 5,971,182 | * | 10/1999 | Gerge et al. | 215/252 |

FOREIGN PATENT DOCUMENTS

| | | |
|---|---|---|
| 10152156 | 6/1998 | (JP) . |
| 9627532 | 9/1996 | (WO) . |

* cited by examiner

*Primary Examiner*—Allan N. Shoap
*Assistant Examiner*—Joe Merek

(57) ABSTRACT

A tamper-indicating closure of integrally molded plastic construction that includes a base wall having a peripheral skirt with an internal thread for affixing the closure to the container finish. A tamper-indicating band is connected to an edge of the skirt by frangible bridges. A stop flange extends from an edge of the band remote from the skirt for abutment with a bead on the container finish to inhibit removal of the closure absent fracture of the frangible means. A plurality of circumferentially spaced openings extend radially through the skirt at a position between the frangible bridges and the internal thread. These openings provide for ingress of cleansing solution during a washing operation after the closure is applied to a container to flush any residue from between the tamper-indicating band and the closure finish. Drain openings preferably are provided in the stop flange and/or the tamper-indicating band to allow drainage of the flushing solution, and also to allow drainage of any accumulated liquid in wet-finish applications.

16 Claims, 2 Drawing Sheets

TAMPER-INDICATING CLOSURE AND METHOD OF MANUFACTURE

The present invention relates to tamper-indicating closures, to methods of manufacturing such closures, and to a package that includes such a closure on a container.

BACKGROUND AND OBJECTS OF THE INVENTION

It is conventional to form a tamper-indicating closure having a band connected to the skirt of the closure by integral frangible bridges. The band has a stop element (e.g., a flange or bead) that engages a bead on the container to resist unthreading of the closure, so that removal of the closure ruptures the frangible bridges that connect the band to the closure skirt. U.S. Pat. Nos. Re. 33,265, 4,322,009 and 4,432,461, assigned to the assignee hereof, disclose tamper-indicating closures of this character, in which the tamper-indicating band is completely severed from the closure skirt and remains with the container upon removal of the closure from the container. U.S. Pat. No. 5,295,600, also assigned to the assignee hereof, discloses a tamper-indicating closure in which the tamper-indicating band remains connected to the closure skirt and is removed from the container with the closure.

Although tamper-indicating closures of the types disclosed in the noted patents have enjoyed substantial commercial acceptance and success in the art, further improvements remain desirable. In particular, it is desirable in many applications to provide facility for flushing the region between the tamper-indicating band and the container finish so as to prevent accumulation of liquid after a filling operation. For example, problems are encountered when employing this type of closure in so-called wet finish applications, in which liquid may spill during or after the filling operation onto the outside surface of the container finish so as to be disposed between the container finish and the closure skirt after capping. Wet finish situations of this type are encountered during hot-fill, cold-fill and aseptic-fill situations, in which the containers are filled close to the brim or to overflow prior to capping. Wet finish situations can also be encountered during filling operations in which liquid may drip from the filling machinery onto the container finish. In wet-finish situations of this type, problems are encountered in connection with draining and drying of the area between the outer surface of the container finish and the closure skirt—i.e., between the threads on the container finish and skirt, and around the tamper-indicating band and the stop element. Liquid trapped within this area can result in growth of mold and mildew.

It is a general object of the present invention to provide a closure and a method of manufacturing a closure that facilitate flushing of the area between the tamper-indicating band and the container finish during an otherwise conventional washing operation after the closure is applied to the container finish. A further object of the present invention is to provide a closure and method of manufacture that facilitate both drainage of liquid products after capping and improved air flow between the closure and container finish for drying after capping. Another and related object of the present invention is to provide a closure and method of manufacture that achieve the foregoing objectives while retaining the advantages of the closures disclosed in the above-noted patents in terms of ease of application to the container finish after filling (lower top load and lower temperature) and whole or partial rupture of the tamper-indicating band from the closure skirt to provide the tamper-indicating feature. Yet another object of the present invention is to provide a package, which includes a closure and a container, that is particularly well adapted for use in conjunction with wet finish applications as described.

SUMMARY OF THE INVENTION

A tamper-indicating closure of integrally molded plastic construction in accordance with presently a preferred embodiment of the invention includes a base wall having a peripheral skirt with internal means, such as a thread or bead, for affixing the closure to the container finish. A tamper-indicating band is connected to an edge of the skirt by frangible means, such as a thin membrane or a plurality of circumferentially spaced integral frangible bridges. Stop means, such as a flange or bead, extends from an edge of the band remote from the skirt for abutment with a bead on the container finish to inhibit removal of the closure absent fracture of the frangible means. A plurality of circumferentially spaced openings extend radially through the skirt at a position between the frangible means and the internal means. These openings provide for ingress of cleansing solution during a washing operation after the closure is applied to a container to flush any residue from between the tamper-indicating band and the closure finish. Drain openings preferably are provided in the stop means and/or the tamper-indicating band to allow drainage of the flushing solution, and also to allow drainage of any accumulated liquid in wet-finish applications.

The radial openings preferably extend through the skirt at a position spaced from and not intersecting the frangible means that connect the tamper-indicating band to the free edge of the skirt, such that the openings remain peripherally bounded by the skirt upon fracture of the frangible means and separation of the band from the skirt. With the through-openings so bounded or surrounded by the closure skirt, the openings do not present sharp edges or burrs at the free edge of the skirt following separation of the tamper-indicating band, which might snag on anything that comes into contact with the closure skirt. In the preferred embodiment of the invention, the skirt is flared radially outwardly between the base wall and the frangible means to facilitate manufacture. The plurality of circumferentially spaced openings in the skirt extend radially through the flared portion of the skirt.

In accordance with another aspect of the present invention, there is provided a method of making a tamper-indicating closure that comprises the step of integrally molding a closure of plastic as-molded construction that includes a base wall having a peripheral skirt with internal means for affixing the closure to a container, a tamper-indicating band connected by frangible means to an edge of the skirt, stop means extending from an edge of the band remote from the skirt for abutment with the container finish to inhibit removal of the closure absent fracture of the frangible means, and a plurality of circumferentially spaced openings that extend radially through the skirt at a position between the frangible means and the base wall. The closure is molded by injection molding or compression molding. A third aspect of the invention contemplates such a closure on a container having a finish with an external thread and an external bead for abutment with the stop means.

A method of filling and capping a container in accordance with another aspect of the present invention includes providing a container having a finish with an external thread and an external bead. A tamper-indicating closure has a base wall, a peripheral skirt with an internal thread for engaging the external thread on the container finish, a band connected to the skirt by frangible means, a flange extending from the band for engagement with the external finish bead, and a circumferential array of openings extending through the skirt between the internal thread and the frangible means. The container is filled and the closure is applied to the container finish. Cleansing solution is then directed against the closure skirt, with a portion of such solution passing through the openings in the closure skirt to cleanse the area between the band and the container finish. The closure preferably is provided with drain openings through the band and/or the flange for facilitating drainage of such cleansing solution.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
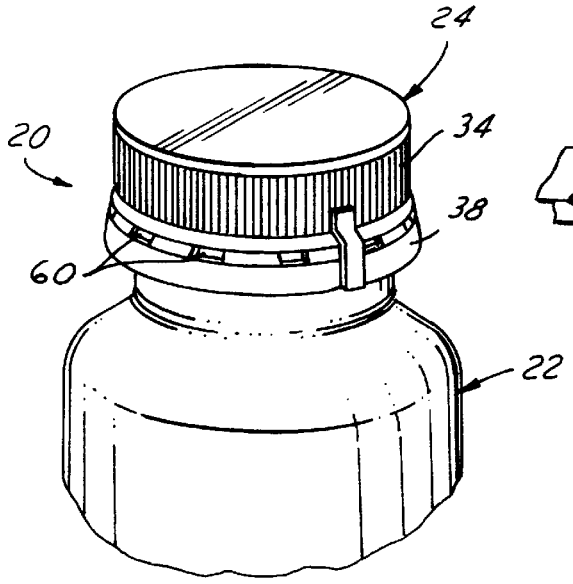
FIG. 1 is a fragmentary perspective view of a container and closure package in accordance with a presently preferred embodiment of the invention.

FIGS. 1–5 illustrate a package 20 in accordance with one presently preferred embodiment of the invention as comprising a container 22 of glass or molded plastic construction and a tamper-indicating closure 24 threaded thereon. Container 22 has an axially extending finish 26 for receiving closure 24. Closure 24 has a flat base wall 30 on which a sealing liner 32 is secured. An annular peripheral skirt 34 extends downwardly from closure base wall 30, and has at least one internal thread 36 for securing closure 24 over an external thread 28 of container 22. (Directional descriptions such as "downwardly" are taken with reference to the vertical orientation of the container and closure illustrated in FIGS. 1 and 2.) A tamper-indicating band 38 is secured to the lower end of skirt 34, being separated therefrom by a circumferential score 40. Tamper-indicating band 38 is thus coupled to closure skirt 34 by a circumferentially spaced array of frangible bridges. These bridges may be formed during the scoring operation, as described in the patents referenced hereinafter. Alternatively, the bridges may be molded onto the inside surface of skirt 34 and band 38, as shown in U.S. Pat. Nos. 4,407,422 and 4,418,828. Alternatively, but less preferably, band 38 may be connected to skirt 34 by a thin frangible web integrally molded with the closure. A stop flange 42 extends radially inwardly and axially upwardly (FIG. 2) from the lower inside edge of band 38 to a position beneath a radially outwardly extending bead 44 on container 22 beneath thread 28. Bead 44 is sometimes called the container transfer bead or the "A" bead, referring to the fact that bead 44 defines the "A" dimension of the container finish. Stop flange 42 preferably is thinnest at the connection with band 38, and thickens uniformly to the free-edge that abuts container bead 44.

Closure 24 may be injection molded as shown or compression molded as taught in U.S. Pat. No. 5,554,327. Liner 32 may be separately formed, or more preferably compression molded in situ within a preformed closure as disclosed in U.S. Pat. Nos. 4,984,703 and 5,451,360. U.S. Pat. Nos. 5,488,888, 5,522,203 and 5,564,319 disclose techniques for forming the score line and bridges in the scoring operation. U.S. Pat. No. 5,755,347 and U.S. Pat. No. Re 33,265 disclose techniques for inverting stop flange 42 from the as-molded configuration of FIG. 3 to the configuration of FIG. 2 ready for use. All patents noted herein, assigned to the assignee hereof, are incorporated herein by reference for purposes of background.

Figure 2:
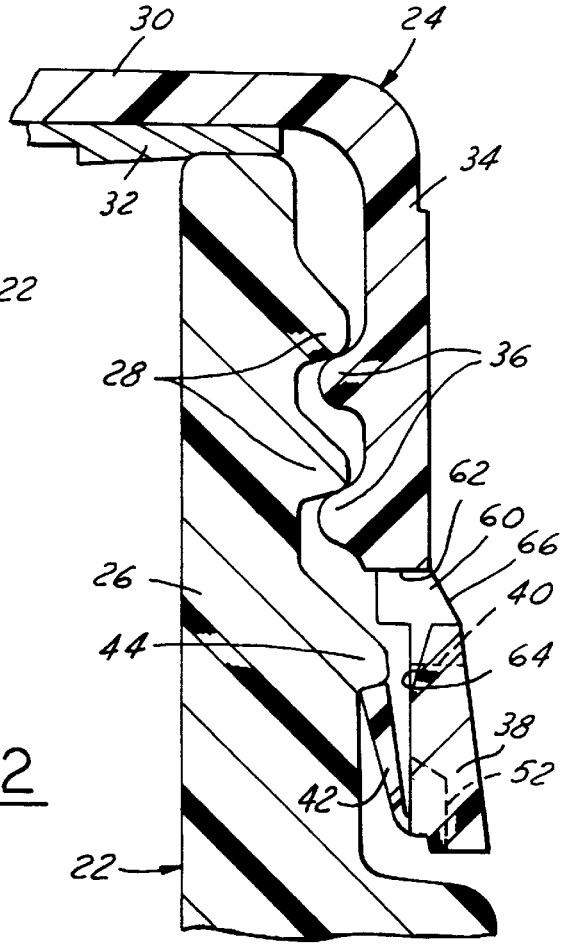
FIG. 2 is a fragmentary sectional view that illustrates the container finish and closure in the package of FIG. 1.
Figure 3:
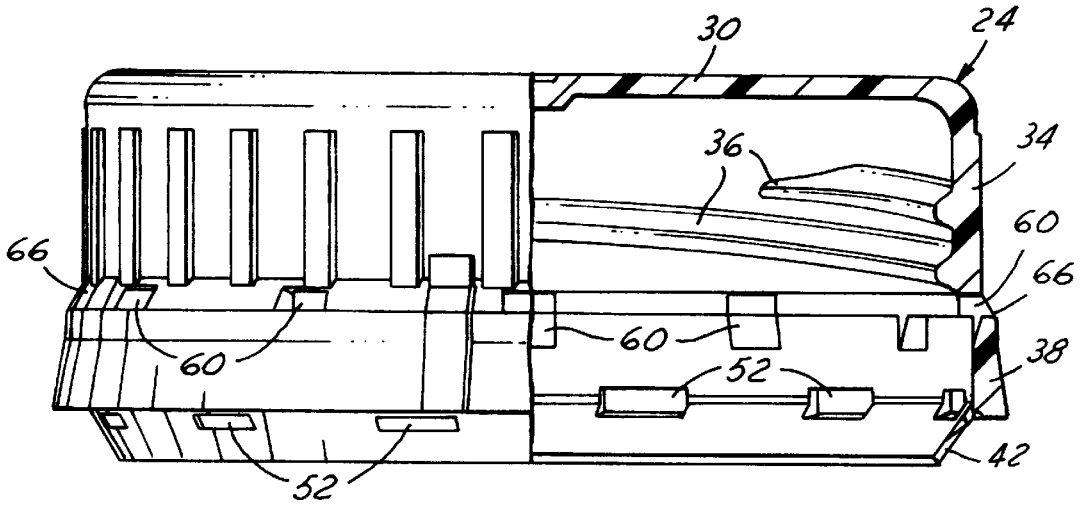
FIG. 3 is a partially sectioned side elevational view of the closure in the package of FIGS. 1 and 2 as molded—i.e., before stop flange inversion.
Figure 4:
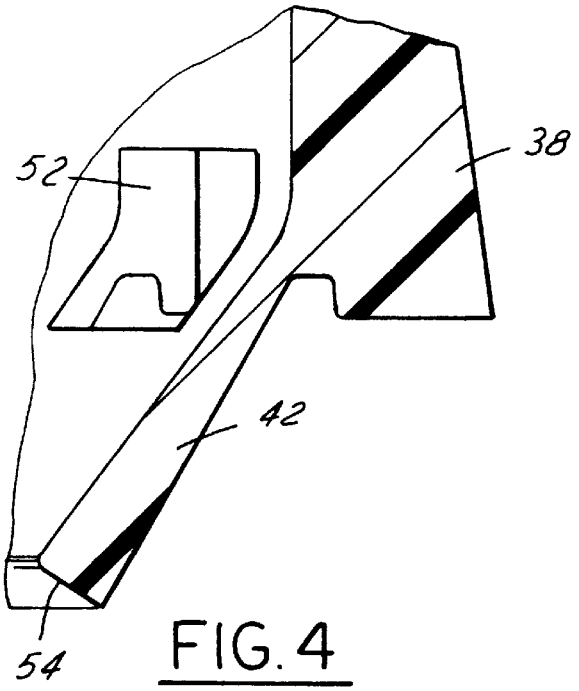
FIG. 4 is a fragmentary sectional view of the portion of the closure within the circle 4 in FIG. 3.
Figure 5:
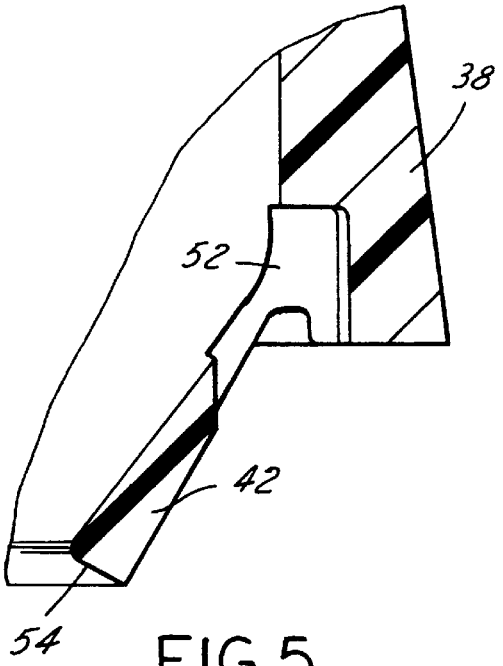
FIG. 5 is a fragmentary sectional view taken substantially along the line 5—5 in FIG. 3.

FIGS. 3–5 illustrate closure 24 as molded, before inversion of stop flange 42, formation of score line 40 and molding of liner 32. A circumferential array of drain openings 52 are formed in stop flange 42 and/or band 38 during the molding operation. Drain openings 52 are disposed immediately adjacent to tamper-indicating band 38, and preferably extend radially into the inner surface of band 38, as best seen in FIG. 5. The walls that define the openings in flange 42 and band 38 are axially oriented and parallel to each other due to the axial orientation of the mold tooling that forms the openings. Openings 52 are entirely bounded by flange 42 and band 38. That is, drain openings 52 do not extend to the free edge 54 of stop flange 42 remote from band 38. Rather, stop flange free edge 54 is circumferentially continuous and disposed in a plane parallel to the plane of closure base wall 30 both prior to inversion (FIGS. 3–5) and after inversion (FIG. 2). In a 48 mm embodiment of the invention illustrated in FIGS. 1–5, drain openings 52 are rectangular, having a radial dimension of 0.060 inches and a circumferential dimension of 0.188 inches. Openings 52 extend 0.030 inches into band 38, which has a lower end thickness of 0.030 inches. The total radial and axial length of flange 42, measured from band 38, is 0.156 inches. The thickness of flange 42 adjacent to band 38 is 0.013 to 0.015 inches, and the thickness at the free edge of the band is 0.030 inches.

A circumferential array of openings 60 extend radially through skirt 34. The array of openings 60 is disposed axially between the lower end of skirt internal thread 36 and the frangible means 40 that separate skirt 34 from band 38. The number of openings 60 in skirt 34 preferably is equal to the number of drain openings 52 in band 38 and/or flange 42, with one skirt through-opening 60 being disposed midway between each adjacent pair of drain openings 52. Each opening 60 includes a main radial portion 62 and a secondary axial portion 64. Axial portion 64 is provided for manufacturing convenience. The periphery of at least the main radial portion 62 of each opening 60 is spaced from frangible means 40 so that, upon separation of band 38 from skirt 34 by fracture of frangible means 40, the periphery of opening 60 remains bounded by the skirt. In other words, separation at frangible means 40 does not rupture the periphery of openings 60. This prevents snagging of the edge of the skirt after the tamper-indicating band has been separated. In the preferred embodiment of the invention illustrated in the drawings, a portion 66 of skirt 34 is flared radially outwardly beneath thread 36. This flared portion 66 is provided to facilitate manufacture in a compression or injection molding operation. Skirt through-openings 60 preferably extend radially through this flared portion 66 of skirt 34. In the preferred 48 mm embodiment of the invention illustrated in the drawings, openings 60 are rectangular, having a circumferential dimension of 0.126 inches and an axial dimension of 0.050 inches. There are twelve equally-spaced skirt through-openings 60 (and twelve equally-spaced drain openings 52). Surface 64 has a preferred angle of 15° to the closure axis. The angle of flared skirt portion 66 is preferably 30° to the closure axis.

In use, closure 24 is either injection or compression molded as described, liner 32 is formed therein, and flange 42 is inverted to the configuration illustrated in FIG. 2. Container 22, which may be formed in any suitable forming operation, is filled with liquid, and closure 24 is applied thereto using conventional closure application apparatus. With the closure so applied, the closure assumes the configuration illustrated in FIG. 2. After filling and capping, the container package 20 is conventionally fed through a cleansing stage, in which cleansing solution is directed onto closure 24 and the upper portion of container 22. Such cleansing may be performed by a circumferential array of nozzles directing water or other cleansing solution onto the container package, or by a lesser number of cleansing solution nozzles while the container package is rotated during passage through the cleansing station. In any event, cleansing solution freely passes through openings 60 and drain openings 52, flushing any material that may have accumulated between tamper-indicating band 38, flange 42 and container finish 26.

What is claimed is:

1. A tamper-indicating closure of integrally molded plastic construction, which includes a base wall having a peripheral skirt with an internal thread for securing the closure to a container, a tamper-indicating band connected by frangible means to an edge of said skirt, a shoulder on said skirt conically flaring radially outwardly between said thread and said frangible means, and a stop flange extending axially and radially from an edge of said band remote from said skirt for abutment with a container to inhibit removal of the closure absent fracture of said frangible means, wherein a plurality of circumferentially spaced openings are molded into and extend radially through said conically flaring shoulder on said skirt between said frangible means and internal thread, said opening being spaced from frangible means, and wherein a plurality of circumferentially spaced openings extend axially through said band adjacent to said flange, through said flange adjacent to said band, or through both said flange and said band.

2. The closure set forth in claim 1 wherein said axially extending openings are larger than said radially extending openings.

3. The closure set forth in claim 2 wherein said radially extending openings are equal in number to said axially extending openings, and wherein said radial openings and said axial openings are circumferentially staggered around said skirt and said band.

4. The closure set forth in claim 3 wherein said radially extending openings and said axially extending openings are of substantially rectangular geometry.

5. The closure set forth in claim 2 wherein said radially extending openings extend through said conically flaring shoulder on said skirt at a position spaced from and not intersecting said frangible means, such that said openings remain peripherally bounded by said skirt upon fracture of said frangible means and separation of said band from said skirt.

6. A package that comprises a container having a finish with an external thread and an external bead disposed beneath said finish, and a tamper-indicating closure of integrally molded plastic construction that includes:

a base wall having a peripheral skirt with an internal thread for securing the closure to the container finish, a tamper-indicating band connected by frangible means to an edge of said skirt, a shoulder on said skirt conically flaring radially outwardly between said thread and said frangible means, a stop flange extending from an edge of said band remote from said skirt for abutment with the container bead to inhibit removal of the closure absent fracture of said frangible means, a plurality of circumferentially spaced openings molded into and extending radially through said conically flaring shoulder on said skirt at a position between said frangible means and internal thread, said opening being spaced from said frangible means, and a plurality of circumferentially spaced openings extend axially through said band adjacent to said flange, through said flange adjacent to said band, or through both said flange and said band.

7. The package set forth in claim 6 wherein said axially extending openings are larger than said radially extending openings.

8. The package set forth in claim 7 wherein said radially extending openings are equal in number to said axially extending openings, and wherein said radial openings and said axial openings are circumferentially staggered around said skirt and said band.

9. The package set forth in claim 8 wherein said radially extending openings and said axially extending openings are of substantially rectangular geometry.

10. The package set forth in claim 7 wherein said radially extending openings extend through said conically flaring shoulder on said skirt at a position spaced from and not intersecting said frangible means, such that said openings remain peripherally bounded by said skirt upon fracture of said frangible means and separation of said band from said skirt.

11. A method of making a tamper-indicating closure that includes the step of:

integrally molding a closure of plastic as-molded construction that includes a base wall having a peripheral skirt with an internal thread for securing the closure to a container, a tamper-indicating band connected by frangible means to an edge of said skirt, a shoulder on said skirt conically flaring radially outwardly between said internal thread and said frangible means, a stop flange extending axially and radially from an edge of said band remote from said skirt for abutment with a container to inhibit removal of the closure absent fracture of said frangible means, a plurality of circumferentially spaced openings molded into and extending radially through said conically flaring shoulder on said skirt at a position between said frangible means and said internal thread, said opening being spaced from said frangible means, and a plurality of circumferentially spaced openings extending axially through said band adjacent to said flange, through said flange adjacent to said band, or through both said flange and said.

12. The method set forth in claim 11 wherein said step of molding said closure is selected from the group consisting of injection molding said closure and compression molding said closure.

13. The closure set forth in claim 11 wherein said axially extending openings are larger than said radially extending openings.

14. The method set forth in claim 3 wherein said radially extending openings are equal in number to said axially extending openings, and wherein said radial openings and said axial openings are circumferentially staggered around said skirt and said band.

15. The closure set forth in claim 14 wherein said radially extending openings and said axially extending openings are of substantially rectangular geometry.

16. The method set forth in claim 11 wherein said radially extending openings extend through said conically flaring shoulder on said skirt at a position spaced from and not intersecting said frangible means, such that said openings remain peripherally bounded by said skirt upon fracture of said frangible means and separation of said band from said skirt.

* * * * *